US011845196B2

(12) United States Patent
Giovanneschi et al.

(10) Patent No.: US 11,845,196 B2
(45) Date of Patent: Dec. 19, 2023

(54) NOTCHING MACHINE

(71) Applicant: EMMECI S.P.A., Cerreto Guidi (IT)

(72) Inventors: Alessio Giovanneschi, Montopoli in val D'Arno (IT); Pablo Baroni, Vicopisano (IT)

(73) Assignee: EMMECI S.P.A., Cerreto Guidi (IT)

( * ) Notice: Subject to any disclaimer, the term of this patent is extended or adjusted under 35 U.S.C. 154(b) by 158 days.

(21) Appl. No.: 16/928,761

(22) Filed: Jul. 14, 2020

(65) Prior Publication Data

US 2021/0023732 A1 Jan. 28, 2021

(30) Foreign Application Priority Data

Jul. 17, 2019 (IT) ..... 102019000012114

(51) Int. Cl.
*B26F 1/12* (2006.01)

(52) U.S. Cl.
CPC ..... *B26F 1/12* (2013.01)

(58) Field of Classification Search
CPC ..... B26F 1/00; B26F 1/12; B26D 3/14
USPC ..... 83/51, 917
See application file for complete search history.

(56) References Cited

U.S. PATENT DOCUMENTS 3,137,218 A * 6/1964 Elliott ..... B31B 50/00 493/364
3,308,723 A * 3/1967 Bergh, Jr. ..... B31B 50/00 493/370
3,877,332 A * 4/1975 Roch ..... B21D 43/287 83/76.3
4,226,149 A * 10/1980 Feldkamper ..... B26D 1/626 83/345
4,710,156 A * 12/1987 Vossen ..... B31B 50/252 493/1
5,181,899 A * 1/1993 Hill ..... B31B 50/16 493/34
5,389,060 A * 2/1995 Huo-Mu ..... B31B 50/256 144/136.9
5,624,369 A * 4/1997 Bidlack ..... B31B 50/00 83/681
5,964,686 A * 10/1999 Bidlack ..... B26F 1/00 493/63
6,245,004 B1 * 6/2001 Waters ..... B26F 1/3813 493/473

(Continued)

FOREIGN PATENT DOCUMENTS

EP 2860023 A 4/2015
GB 2295986 A 6/1996

*Primary Examiner* — Adam J Eiseman
*Assistant Examiner* — Richard D Crosby, Jr.
(74) *Attorney, Agent, or Firm* — Pearne & Gordon LLP; Bryan M. Gallo

(57) ABSTRACT

A method for making a paper blank from a corresponding paper sheet includes: loading a paper sheet along a longitudinal orientation, resting on a supporting surface that defines a worktop; moving a carriage in parallel with the worktop; making a primary cut on the paper sheet along a cutting orientation perpendicular to the worktop, using a primary blade which slides relative to a primary anvil; making a secondary cut, sliding a secondary blade and a secondary anvil relative to each other at a secondary cutting unit. The primary cutting unit and the secondary cutting unit are actuated by an actuating assembly.

10 Claims, 8 Drawing Sheets

(56) References Cited

U.S. PATENT DOCUMENTS

| | | | | |
|---|---|---|---|---|
| 6,443,042 | B1 * | 9/2002 | Caputo | B26F 1/12 83/636 |
| 6,652,434 | B2 * | 11/2003 | Benzoni | B26D 3/14 83/299 |
| 6,732,625 | B1 * | 5/2004 | Boynton | B26D 7/2621 83/482 |
| 8,579,777 | B2 * | 11/2013 | Hatano | B31B 50/00 493/182 |
| 8,875,608 | B2 * | 11/2014 | Lewalski | B26D 7/2628 83/482 |
| 8,887,607 | B2 * | 11/2014 | Cavagna | B26D 7/2621 83/482 |
| 11,104,094 | B2 * | 8/2021 | Giovanneschi | B31B 50/005 |
| 2002/0142906 | A1 * | 10/2002 | Benzoni | B26D 3/12 493/370 |
| 2003/0150313 | A1 * | 8/2003 | Rinaldo | B26D 3/14 83/504 |
| 2005/0166746 | A1 * | 8/2005 | Garrett | B26D 3/12 83/885 |
| 2012/0115699 | A1 * | 5/2012 | Capoia | B31F 1/10 493/324 |
| 2017/0014884 | A1 * | 1/2017 | Dechamps | B23D 15/002 |
| 2017/0080666 | A1 * | 3/2017 | Graham | B31B 50/74 |

* cited by examiner

NOTCHING MACHINE

BACKGROUND OF THE INVENTION

This invention relates to a notching machine for notching sheets of paper and to a method for notching a sheet of paper.

Notching machines are machines which cut notches in sheets of paper to make blanks which are then used to cover cardboard boxes.

To be able to cover the cardboard boxes correctly, the paper must be made to adapt to the shape of the box without forming wrinkles or other defects which would spoil the appearance of the box.

In the field of notching machines, prior art solutions include an outer frame which mounts a cutting assembly used to make the necessary cuts on a respective corner of the paper sheet. In the prior art solutions, the cutting assembly comprises a primary cutting unit and a secondary cutting unit, responsible for making a respective primary cut and secondary cut on the paper sheet.

The primary cut and the secondary cut are substantially juxtaposed side by side. This creates size problems which have led to the development of notching apparatuses which make the primary cut and the secondary cut one after the other and not simultaneously.

In some of these solutions, the cutting unit is movable relative to the frame to a limited extent. Their flexibility with regard to the size of the boxes that the machine is capable of processing is therefore reduced. Moreover, having a single cutting unit means that notching is a slow process and that the sheet has to be moved manually to make the cuts on all the corners of the paper sheet.

In response to the need to speed up the notching process, some solutions have implemented an additional cutting assembly working in parallel with the cutting assembly to make the primary and secondary cuts on another corner.

In prior art solutions such as the one described in document EP2860023B1 or GB2295986A, for example, the primary cutting unit and the secondary cutting unit are different. More specifically, the primary cutting unit is a shear type cutter. In other words, the primary cutting unit comprises a primary blade and a primary anvil. The primary blade slides relative to the respective primary anvil until they interfere with each other relative to an orientation perpendicular to the sliding orientation of the primary blade. The secondary cutting unit, on the other hand, is a pressure cutting unit, in which a secondary blade compresses the sheet (or sheets) of paper until it meets a stop surface. In this solution, the stop surface is defined by the primary anvil. In this solution, therefore, the primary cut and the secondary cut are made almost simultaneously.

This solution has several disadvantages, however. First of all, the pressure cut is less reliable, with a higher probability that some of the paper sheets, usually those at the bottom of the stack, remain uncut. Also, the necessary impact of the secondary blade against the stop surface considerably increases wear and maintenance costs associated with the stop surface. Furthermore, it does not meet the need to adapt the machine to the thickness of the box which the paper blank is used to cover and it thus reduces the aesthetic quality of the end product.

Moreover, the pressure cut takes longer than the shear cut. This reduces the advantage of making the primary and secondary cuts simultaneously to save time.

SUMMARY OF THE INVENTION

The aim of this invention is to provide a notching apparatus and a notching method to overcome the above mentioned disadvantages of the prior art.

This aim is fully achieved by the notching apparatus and notching method of this disclosure as characterized in the appended claims.

According to one aspect of it, this disclosure provides a notching machine for making a paper blank from a corresponding paper sheet.

The machine comprises a frame. The machine comprises a supporting surface defining a worktop to supportably receive the paper sheet being processed.

The paper sheet is received along a feed direction of sheet loading. Preferably, the feed direction has a longitudinal orientation (direction).

The machine comprises a carriage. The carriage is movable. In an embodiment, the carriage is movable in parallel with the worktop.

The machine comprises a primary cutting unit. The primary cutting unit includes a primary blade. The primary cutting unit includes a primary anvil. In an embodiment, the primary blade is slidable relative to the anvil along a cutting orientation perpendicular to the worktop plane to make a primary shear cut. Other embodiments in which the primary blade is stationary and the primary anvil slides relative to the primary blade are also imaginable.

The machine comprises a secondary cutting unit. In an embodiment, the secondary cutting unit is associated with the carriage.

The machine comprises an actuating assembly. The actuating assembly is configured to move each primary blade relative to the primary anvil or each primary anvil relative to the corresponding primary blade along the cutting orientation.

In an embodiment, the secondary cutting unit includes a secondary blade. In an embodiment, the secondary cutting unit includes a secondary anvil. The secondary blade is slidable relative to the secondary anvil along the cutting orientation to make a corresponding secondary shear cut. Other embodiments in which the secondary blade is stationary and the secondary anvil slides relative to the secondary blade are also imaginable.

In an embodiment, the actuating assembly is configured to move the secondary blade relative to the secondary anvil or the secondary anvil relative to the corresponding primary blade along the cutting orientation.

The carriage is movable between a first position, to enable the primary cutting unit to make the first primary cut, and a second position, to enable the secondary cutting unit to make the cut. In an embodiment, the carriage is movable along the longitudinal orientation. In this embodiment, the first and second positions are longitudinal positions. The carriage is movable between the first position and the second position along a displacement direction. The displacement direction may be longitudinal (the longitudinal direction), or may be inclined or perpendicular to the longitudinal direction. The displacement direction may be parallel (or coincident) to the feed direction of sheet loading; alternatively, the displacement direction may be inclined or perpendicular to the feed direction of sheet loading. In the following description, for the sake of brevity, we refer to longitudinal orientation (direction) for both the displacement direction and the feed direction of sheet loading, without affecting the generalization.

The primary blade of the cutting unit is disposed at a first (longitudinal) coordinate with the carriage at the first position. In an embodiment, a tip of the primary blade, defining a longitudinal limit of the primary blade (preferably in a direction opposite to the sheet loading direction) is at the first longitudinal coordinate with the carriage at the first position.

In an embodiment, the secondary blade of the cutting unit is disposed at a second (longitudinal) coordinate with the carriage at the second position. In an embodiment, a side wall of the secondary blade, defining a longitudinal limit of the secondary blade (preferably in a direction opposite to the sheet loading direction) is at the second longitudinal coordinate with the carriage at the second position.

The distance between the first longitudinal coordinate and the second longitudinal coordinate takes into account (is a function of, is determined as a function of, represents) the thickness of the box on which the blank will be applied.

In an embodiment, the distance between the second longitudinal coordinate and the first longitudinal coordinate is variable.

In an embodiment, the actuating assembly includes a transmission system. In an embodiment, the transmission system is a mechanical transmission system. The mechanical transmission system is configured to move the primary blade relative to the primary anvil, preferably along the cutting orientation. The mechanical transmission system is configured to move the secondary blade relative to the secondary anvil, preferably along the cutting orientation. The mechanical transmission system is configured to move the carriage preferably along the longitudinal orientation.

In an embodiment, the actuating assembly includes an operating actuator. In an embodiment, the operating actuator is a single operating actuator. The single operating actuator is connected to the mechanical transmission system in order to drive it.

In an embodiment, the mechanical transmission system includes a first transmission element. The first transmission element is configured to convert the rotation of the operating actuator into a displacement of the primary blade relative to the primary anvil along the cutting orientation (first movement).

In an embodiment, the mechanical transmission system includes a second transmission element. The second transmission element is configured to convert the rotation of the operating actuator into a displacement of the secondary blade relative to the secondary anvil along the cutting orientation (second movement).

In an embodiment, the mechanical transmission system includes a third transmission element. The third transmission element is configured to convert the rotation of the operating actuator into a displacement of the carriage along the longitudinal orientation (third movement).

In an embodiment, the transmission system is configured to synchronize the first movement, the second movement and the third movement according to a predetermined operating sequence. In other words, the transmission system is configured to synchronize the displacement of the primary blade relative to the primary anvil along the cutting orientation, the displacement of the secondary blade relative to the secondary anvil along the cutting orientation and the displacement of the carriage along the longitudinal orientation.

In an embodiment, the transmission system includes a pushing element. The pushing element is disposed above the first and second cutting units along the cutting orientation. The pushing element is movable along the cutting orientation to move the primary blade and the secondary blade. In other embodiments, the pushing element is movable along the cutting orientation to move the primary anvil and the secondary anvil.

At its first position, the pushing element is configured to start moving the primary blade. At its second position, the pushing element is configured to start moving the secondary blade. In an embodiment, the second position is spaced from the first position along the cutting orientation. In an embodiment, the second position of the pushing element is disposed under the first position along the cutting orientation.

In an embodiment, the machine comprises an adjustment assembly. The adjustment assembly is configured to vary the distance between the first longitudinal coordinate and the second longitudinal coordinate. That way, the machine can adapt to the thickness of the box on which the blank will be applied.

In an embodiment, the adjustment assembly comprises a stop. The stop is movable along the longitudinal orientation. The stop is configured to be a limit to the movement of the carriage along the longitudinal orientation. That way, it is possible to vary the second longitudinal coordinate.

In an embodiment, the adjustment assembly comprises a slide. The slide is disposed on the carriage. The slide is constrained to the movement of the carriage relative to the frame and is thus movable relative to the frame. In an embodiment, the secondary cutting unit is movable along the longitudinal orientation to adjust the second longitudinal coordinate.

In an embodiment, the machine comprises a control unit. The control unit is configured to receive configuration data from a user. The control unit is configured to generate drive signals as a function of the configuration data. The control unit is configured to send the drive signals to the actuating assembly to adjust the position of the carriage on the worktop.

According to one aspect of it, this disclosure provides a method for making a paper blank from a corresponding paper sheet.

In an embodiment, the method comprises a step of preparing a frame. The method comprises a step of loading a paper sheet along a longitudinal orientation, resting on a supporting surface that defines a worktop.

In an embodiment, the method comprises a step of moving a carriage in parallel with the worktop.

The method comprises a step of making a primary cut on the paper sheet, using a primary cutting unit that includes a primary blade and a primary anvil.

In an embodiment, the step of making a primary cut includes a step of sliding the primary blade relative to the primary anvil along a cutting orientation perpendicular to the worktop. In an embodiment, the primary blade slides relative to the primary anvil, whilst in other embodiments, the primary anvil slides relative to the primary blade.

The method comprises a step of making a secondary cut using a secondary cutting unit.

The method comprises a step of actuating the primary cutting unit using an actuating assembly.

In an embodiment, the step of making a secondary cut includes a step of sliding a secondary blade relative to a secondary anvil along a cutting orientation perpendicular to the worktop. In an embodiment, the secondary blade slides relative to the secondary anvil, whilst in other embodiments, the secondary anvil slides relative to the secondary blade.

In an embodiment, the method comprises a step of actuating the secondary cutting unit using the actuating assembly.

In an embodiment, the step of moving the carriage includes a step of moving the carriage along the longitudinal orientation between a first position, where the primary cutting unit makes the primary cut, and a second position, where the secondary cutting unit makes the secondary cut.

In the step of moving the carriage, the primary blade and the secondary blade adopt respective positions along the longitudinal orientation. More specifically, when the carriage is at the first position, the primary blade of the cutting unit is disposed at a first (longitudinal) coordinate, and when the carriage is at the second position, the secondary blade of the cutting unit is disposed at a second (longitudinal) coordinate.

In an example embodiment, when the carriage is at the first position, a tip of the primary blade, defining a longitudinal limit of the primary blade (preferably in a direction opposite to the sheet loading direction) is at the first longitudinal coordinate. When the carriage is at the second position, a side wall of the secondary blade, defining a longitudinal limit of the secondary blade (preferably in a direction opposite to the sheet loading direction) is at the second longitudinal coordinate.

An example application of the method comprises a step of adjusting, in which the distance between the second longitudinal coordinate and the first longitudinal coordinate is adjusted.

In an embodiment, the method comprises a step of transmitting motion. In an embodiment, the step of transmitting is a step of mechanically transmitting. In the step of mechanically transmitting, a mechanical transmission system moves the primary blade relative to the primary anvil along the cutting orientation. In the step of mechanically transmitting, a mechanical transmission system moves the secondary blade relative to the secondary anvil along the cutting orientation. In the step of mechanically transmitting, a mechanical transmission system moves the carriage along the longitudinal orientation. In an embodiment, in the step of transmitting, the mechanical transmission system is driven by a single actuator of the actuating assembly.

In an embodiment, the step of transmitting comprises a first step of transmitting, in which a first transmission element converts the rotation of the operating actuator into a displacement of the primary blade relative to the primary anvil along the cutting orientation (first movement).

In an embodiment, the step of transmitting comprises a second step of transmitting, in which a second transmission element converts the rotation of the operating actuator into a displacement of the secondary blade relative to the secondary anvil along the cutting orientation (second movement).

In an embodiment, the step of transmitting comprises a third step of transmitting, in which a third transmission element converts the rotation of the operating actuator into a displacement of the carriage along the longitudinal orientation (third movement).

In an embodiment, the step of mechanically transmitting includes a step of synchronizing, in which the displacement of the primary blade relative to the primary anvil along the cutting orientation (first movement), the displacement of the secondary blade relative to the secondary anvil along the cutting orientation (second movement) and the displacement of the carriage along the longitudinal orientation (third movement) are synchronized according to a predetermined operating sequence. In an embodiment, the transmission system first performs the first movement, then the third movement and then the second movement.

In an embodiment, the transmission system performs a step of pushing, in which a pushing element adjusts the displacement of the primary blade and of the secondary blade along the cutting orientation.

More specifically, in the step of pushing, the pushing element entrains (presses, comes into contact with) the primary blade before entraining (pressing, coming into contact with) the secondary blade. In the step of pushing, the pushing element entrains (presses, comes into contact with) the primary blade along the cutting orientation to a level above the level, along the cutting orientation, at which it starts entraining (pressing, coming into contact with) the secondary blade.

In an embodiment, the method comprises a step of adjusting, in which an adjustment unit varies the distance between the first longitudinal coordinate and the second longitudinal coordinate to adapt the machine to the thickness of the cardboard on which the blank made from the paper sheet will be applied.

In an embodiment, the step of adjusting comprises a step of adjusting a stop. The stop is moved along the longitudinal orientation to define a limit to the movement of the carriage along the longitudinal orientation.

In an embodiment, the step of adjusting comprises a step of moving the secondary cutting unit relative to the primary cutting unit. In this step of adjusting, the secondary cutting unit moves relative to the primary cutting unit on a slide mounted on the carriage.

The method comprises a step of changing over to a different size. In the step of changing over to a different size, a control unit of the machine receives configuration data. The control unit processes the configuration data and generates corresponding drive signals. The control unit sends the drive signals to the actuator to instruct it to move the carriage along the longitudinal orientation and along the transverse orientation, perpendicular to the longitudinal orientation and included in the plane defined by the worktop.

BRIEF DESCRIPTION OF THE DRAWINGS

This and other features of the invention will become more apparent from the following description of a preferred embodiment of it, illustrated by way of non-limiting example in the accompanying drawings, in which.

DESCRIPTION OF THE PREFERRED EMBODIMENTS

Figure 1:
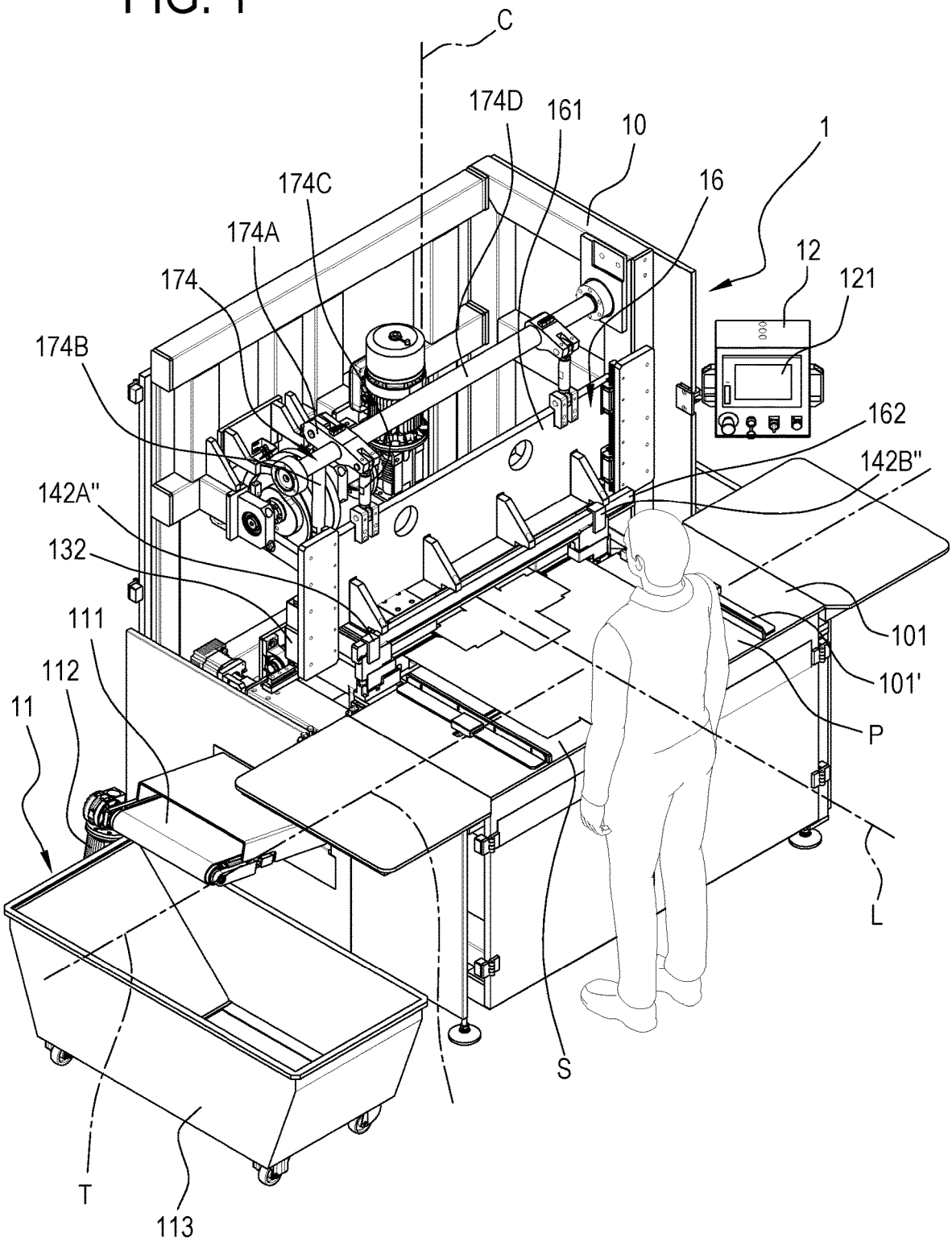
FIG. 1 is a front perspective view of a notching machine according to this disclosure.
Figure 2:
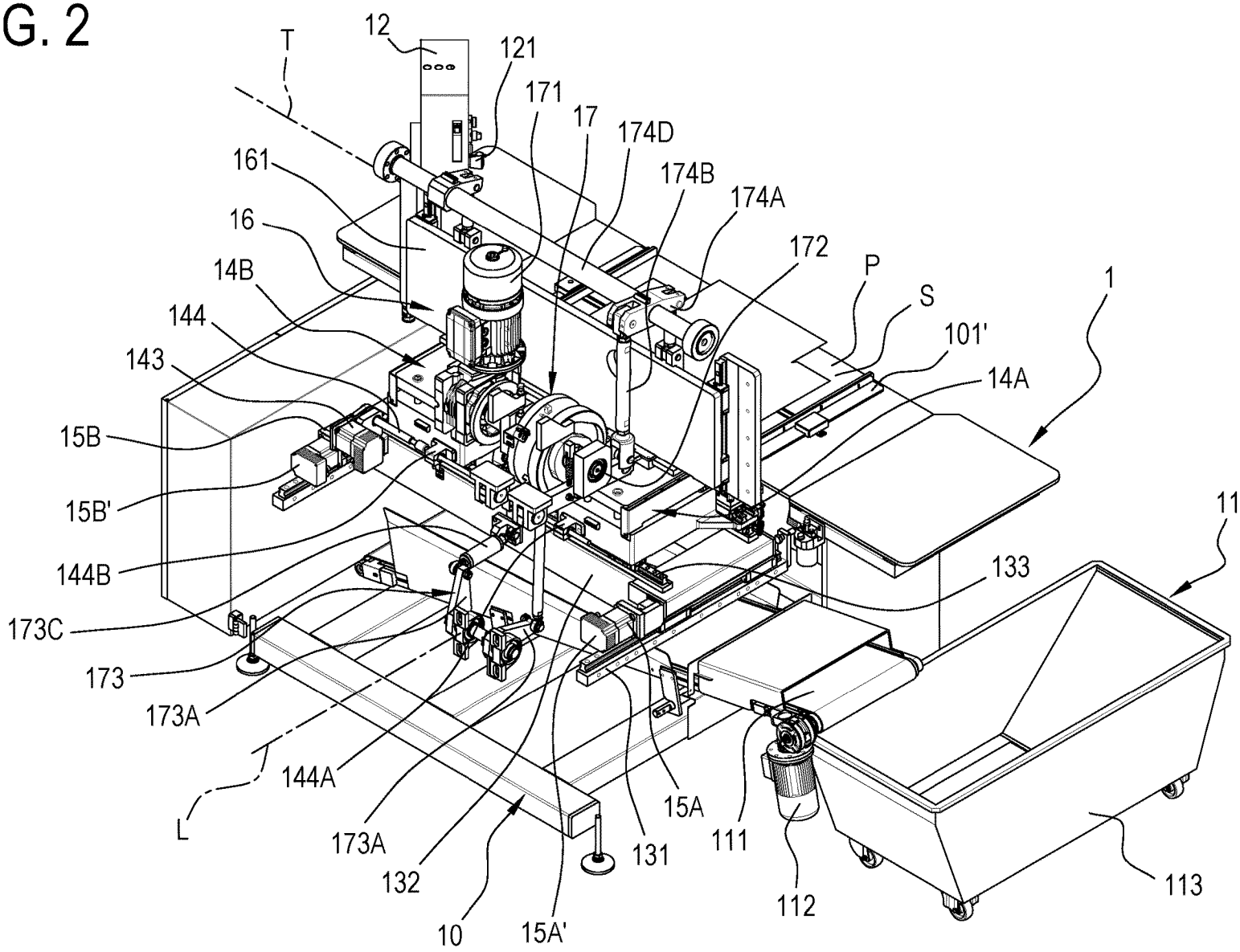
FIG. 2 is a rear perspective view of the notching machine of FIG. 1.
Figure 3:
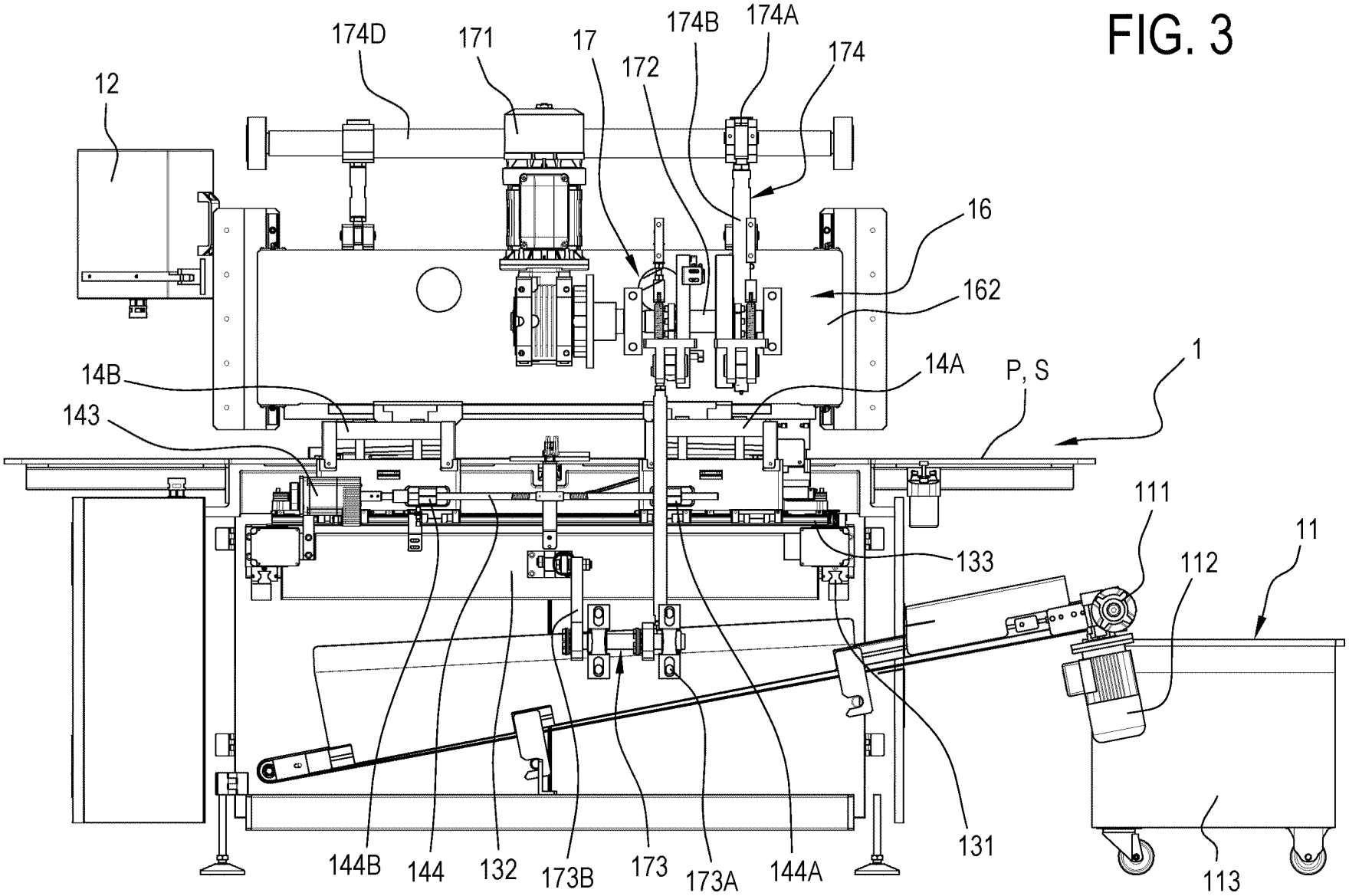
FIG. 3 is a rear side view of the notching machine of FIG. 1.
Figure 4:
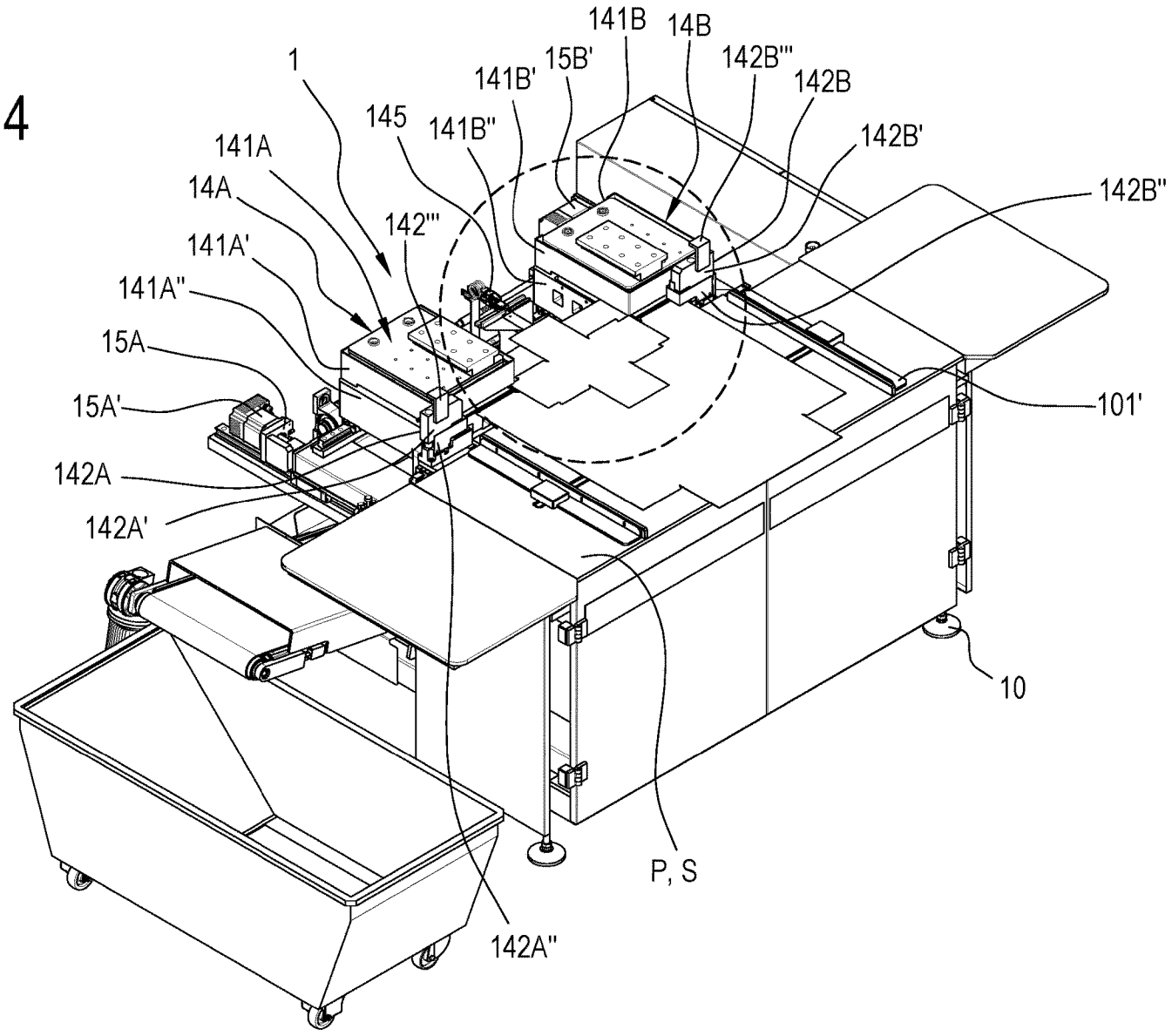
FIG. 4 is a perspective front view of the notching machine of FIG. 1.
Figure 4A:
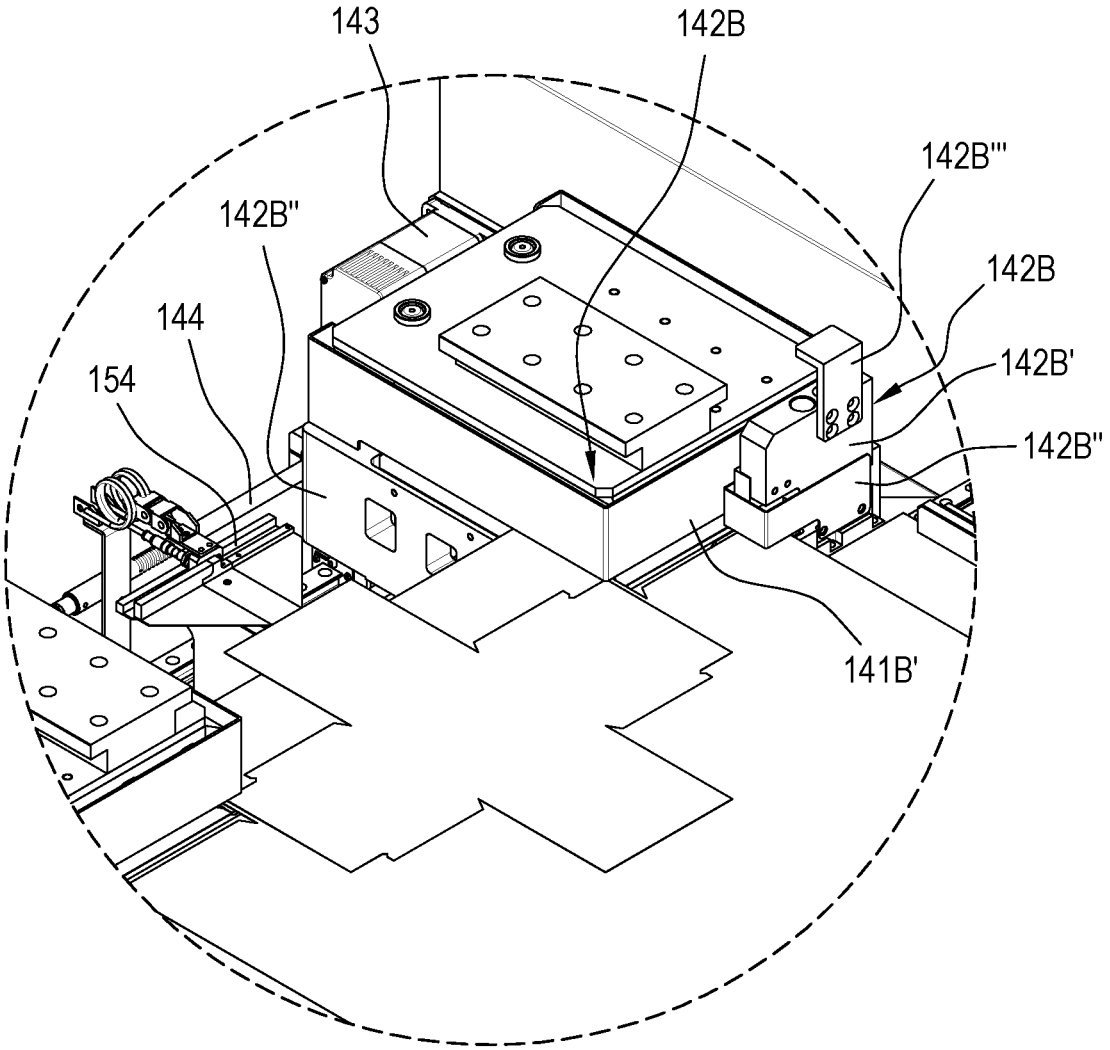
FIG. 4A shows a detail, illustrated in FIG. 4, of the notching machine of FIG. 1.
Figure 5B:
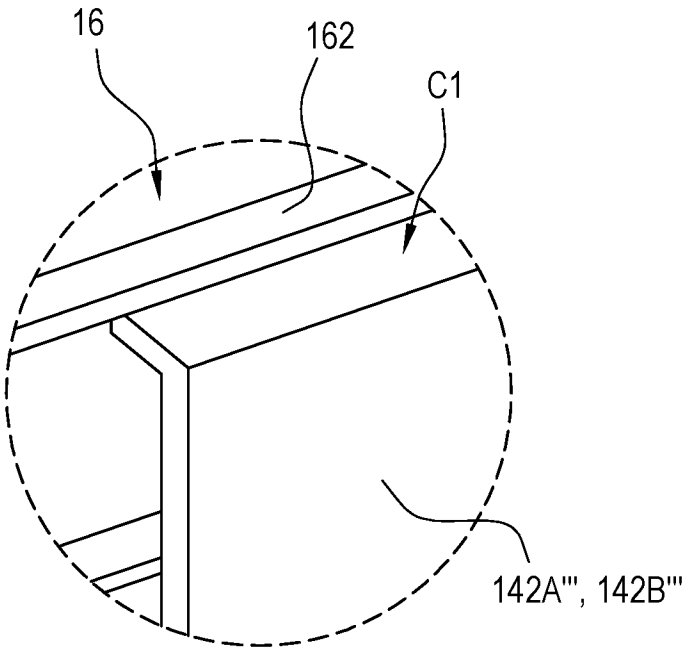
FIGS. 5A and 5B are schematic views of, respectively, a first configuration and a second configuration of a pusher assembly of the notching machine of FIG. 1.
Figure 5A:
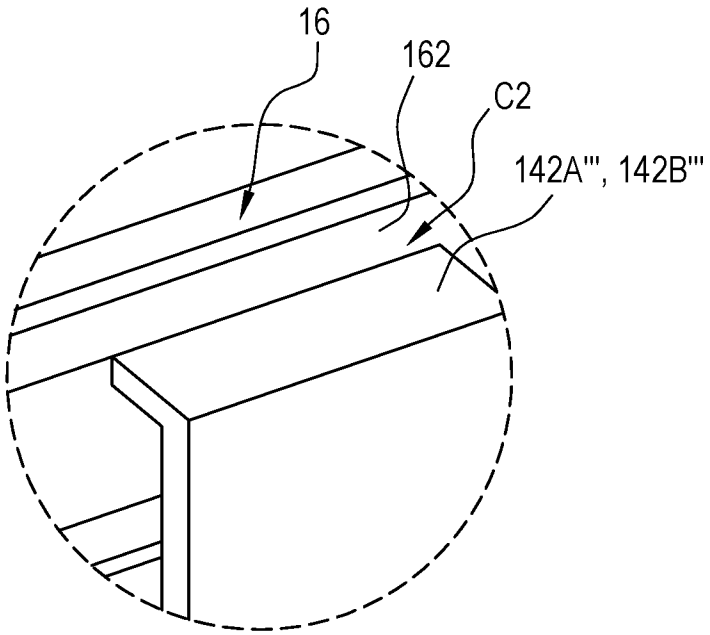
Figure 6:
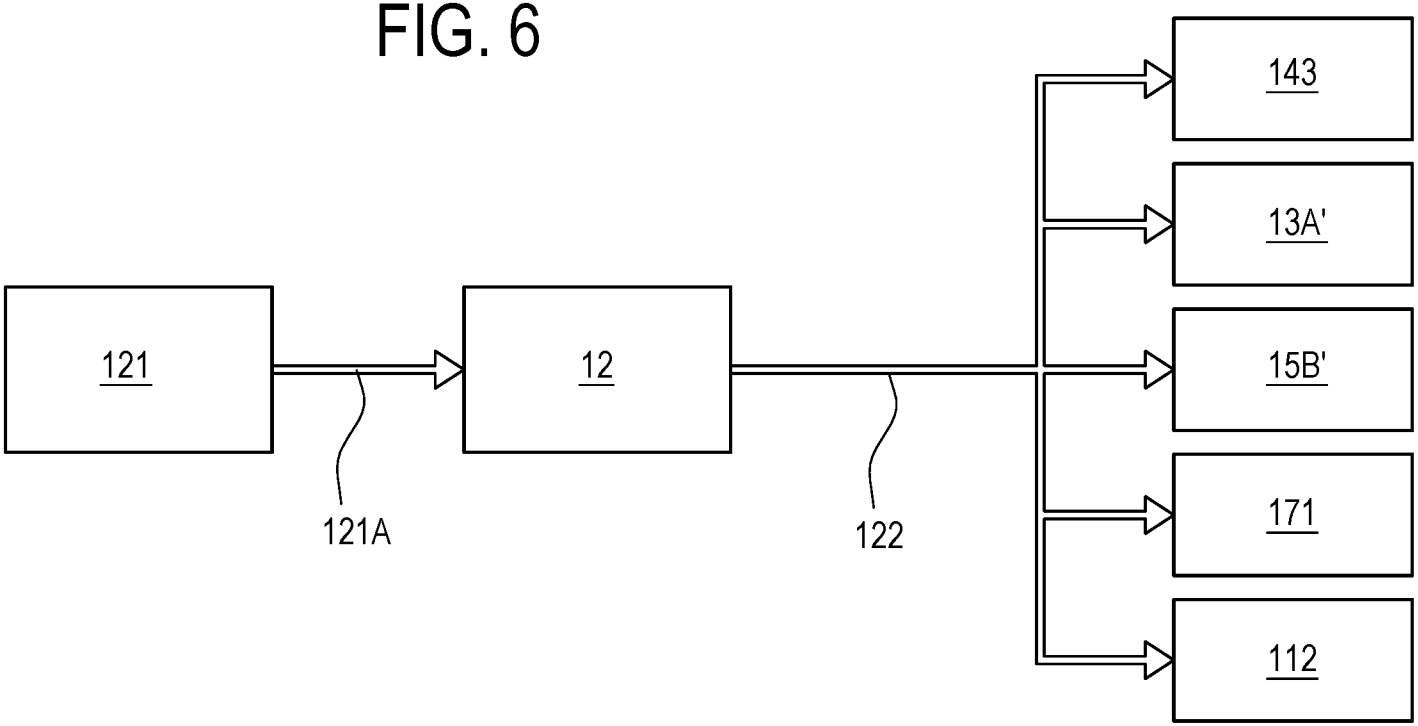
FIG. 6 schematically represents a control logic of the notching machine of FIG. 1.
Figure 7:
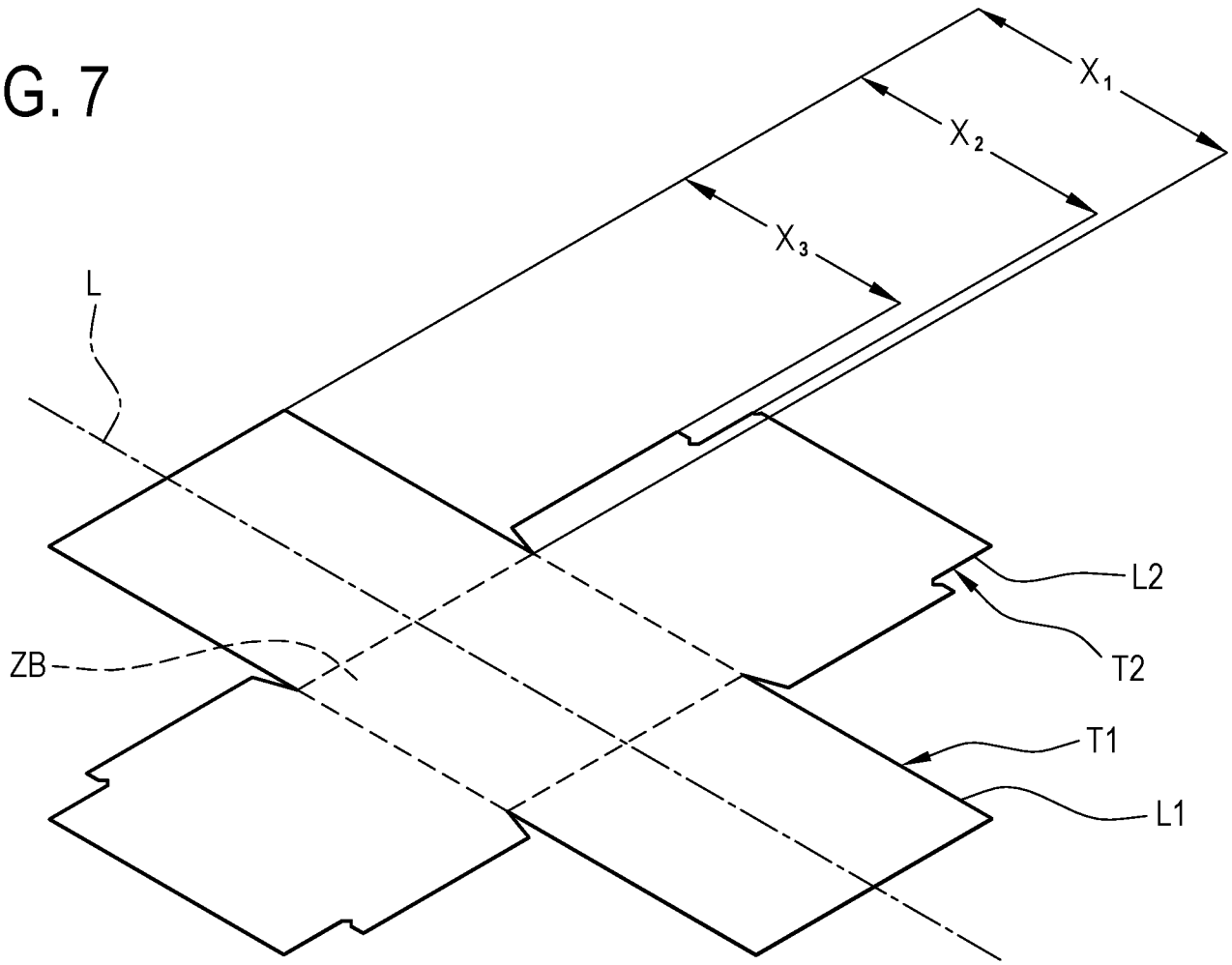
FIG. 7 schematically illustrates a paper blank made by the notching machine of FIG. 1.

With reference to the accompanying drawings, the numeral 1 denotes a notching machine used to cut notches in a paper sheet to make a corresponding paper blank.

The machine 1 comprises a frame 10, configured to support the machine 1 on the floor.

The frame 10 comprises a work table 101, defining a worktop P and having a supporting surface S on which the paper sheet is rested.

The work table 101 comprises a squarer 101' movable on the worktop P to laterally contain the paper sheet in such a way that it does not move during notching. The paper sheet is configured to be loaded onto the worktop P in a longitudinal orientation of loading L.

In an embodiment, the machine 1 comprises a collecting system 11. The collecting system 11 is configured to collect the notching offcuts and to convey them elsewhere.

The collecting system 11 comprises one or more of the following features:

- a collecting conveyor 111 (for example, a collecting belt), disposed along a vertical orientation, parallel to the orientation of the weight force, under the worktop P, to receive the offcuts that fall off the worktop P;
- a collecting actuator 112, associated with the collecting conveyor 111 in order to drive it;
- a collecting container 113, disposed laterally of the frame 10 of the machine 1 and configured to receive the offcuts from the collecting container 111.

In an embodiment, the notching machine 1 comprises a control unit 12, configured to control and/or drive the components of the machine 1.

In an embodiment, the machine 1 comprises a user interface 121, configured to receive configuration data 121A from a user. In an embodiment, the configuration data 121A represent a size of the paper sheet to be notched.

In an embodiment, the machine comprises a first guide element. In an embodiment, the first guide element is a first pair of rails 131. The first pair of rails 131 is connected to the frame 10. The first pair of rails 131 extends along the longitudinal orientation L.

In an embodiment, the machine 1 comprises a carriage 132. The carriage 132 is connected to the first pair of rails 131. The carriage 132 is configured to move along the longitudinal orientation L on the first pair of rails.

In an embodiment, the machine comprises a second guide element. In an embodiment, the second guide element is a second pair of rails 133. The second pair of rails 133 is connected to the frame 10. The second pair of rails 133 extends along a transverse orientation T belonging to the plane defined by the worktop P and perpendicular to the longitudinal orientation L.

In an embodiment, the second pair of rails 133 is disposed on the carriage 132 and is therefore constrained to move with it as it moves along the longitudinal orientation L In an embodiment, the machine comprises a first cutting assembly 14A. In an embodiment, the machine comprises a second cutting assembly 14B. The first cutting assembly 14A and the second cutting assembly 14B are configured to make respective cuts on the paper sheet. The first cutting assembly 14A and the second cutting assembly 14B are spaced along the transverse orientation T.

In an embodiment, the first cutting assembly 14A and the second cutting assembly 14B are associated with the carriage 132, for example by means of the second guide element; thus, in a possible example embodiment, the first cutting assembly 14A and the second cutting assembly 14B are connected to the second pair of rails 133. In an embodiment, the first cutting assembly 14A and the second cutting assembly 14B are movable along the transverse orientation on the second pair of rails 133. The first and second cutting assemblies 14A, 14B include respective heads (or sliders) which are associated with the carriage 132; the primary cutting units 141A, 141B and the secondary cutting units 142A, 142B are mounted on the heads of the first and second cutting assemblies 14A, 14B. Thus, (in the embodiment illustrated) the primary cutting units 141A, 141B and the secondary cutting units 142A, 142B are associated with the carriage 132 indirectly through the heads of the respective cutting assemblies. Alternative embodiments are also imaginable, where, for example, the primary cutting units 141A, 141B and the secondary cutting units 142A, 142B are connected directly to the carriage 132 (for example by means of guide elements).

In an embodiment, the first cutting assembly 14A and the second cutting assembly 14B each include a respective primary cutting unit 141A, 141B. In an embodiment, the first cutting assembly 14A and the second cutting assembly 14B each include a respective secondary cutting unit 142A, 142B.

Each primary cutting unit 141A, 141B is configured to make a respective primary cut T1 on the paper sheet. Each secondary cutting unit 142A, 142B is configured to make a respective secondary cut T2 on the paper sheet.

It should be noted that the primary cut T1 defines a primary cutting line L1. The secondary cut T2 defines a secondary cutting line L2. In an embodiment, the secondary cut T2 is made on the primary cutting line L1.

Each primary cutting unit 141A, 141B comprises a respective primary blade 141A', 141B' and a respective primary anvil 141A", 141B".

Each secondary cutting unit 142A, 142B comprises a respective secondary blade 142A', 142B' and a respective secondary anvil 142A", 142B".

It should be noted that hereinafter, we will refer to the terms "primary blade" and "primary anvil" to extend the features described to both the primary blade and the primary anvil of the first cutting assembly 14A and to the primary blade and the primary anvil of the second cutting assembly 14B.

It should be noted that hereinafter, we will refer to the terms "secondary blade" and "secondary anvil" to extend the features described to both the secondary blade and the secondary anvil of the first cutting assembly 14A and to the secondary blade and the secondary anvil of the second cutting assembly 14B.

In an embodiment, the primary blade 141A', 141B' is disposed along a cutting orientation C, perpendicular to the longitudinal orientation L and to the transverse orientation T, above the corresponding primary anvil 141A", 141B".

In an embodiment, the primary blade 142A', 142B' is disposed along the cutting orientation C, above the corresponding secondary anvil 142A", 142B".

In an embodiment, the primary blade 141A', 141B' is slidable along the cutting orientation C, relative to the corresponding primary anvil 141A", 141B". In an embodiment, the secondary blade 142A', 142B' is slidable along the cutting orientation C, relative to the corresponding secondary anvil 142A", 142B". The primary blade 141A', 141B' and/or the secondary blade 142A', 142B' slide relative to the corresponding primary anvil 141A", 141B" and/or the secondary anvil 142A", 142B", respectively, to make a primary shear cut and/or a secondary shear cut, that is to say, a cut made by the blades and anvils sliding until they cross each other. In other words, with a shear cut, when the primary cut and/or the secondary cut have been made, the primary blade 141A', 141B' and/or the secondary blade 142A', 142B' are at a position, along the cutting orientation C, that is lower than the position of the corresponding primary anvil 141A", 141B" and/or the secondary anvil 142A", 142B", along the cutting orientation C.

In an embodiment, in order to obtain a primary cut and a secondary cut that are both shear cuts, each primary cutting unit 141A, 141B is spaced from the corresponding secondary cutting unit 142A, 142B along the longitudinal orientation L. More specifically, the primary blade 141A', 141B' and the secondary blade 142A', 142B' are spaced along the longitudinal orientation L.

Thus, in an embodiment, the first cutting assembly 14A and the second cutting assembly 14B are configured to make the respective primary cut first, then to move along the longitudinal orientation L and, lastly, to make the secondary cut.

In an embodiment, the carriage 132 is configured to move along the longitudinal orientation L so that between the moment the primary cut is made and the moment the secondary cut is made, the first cutting assembly 14A and the second cutting assembly 14B are moved along the longitudinal orientation L.

In an embodiment, the primary blade 141A', 141B' has an L-shaped cutting edge so as to notch the corners of the paper sheet. For example, the primary blade 141A', 141B' may comprise a first blade and a second blade which are perpendicular to each other to define the cutting line L1. The first blade and the second blade of the primary blade 141A', 141B' each slide relative to a corresponding first anvil and to a second anvil, perpendicular to the first anvil. The first anvil and the second anvil define the primary anvil 141A", 141B"

Once the primary cut has been made, the paper sheet has an outer perimeter in the shape of a cross. In an embodiment, the secondary blade 142A', 142B' has an L-shaped cutting edge so as to notch a corner previously defined by the primary cut.

In an embodiment, each secondary cutting unit 142A, 142B comprises a respective return element 146A, 146B.

The return element 142A, 142B is configured to allow the secondary blade 142A', 142B' to return to its initial position once the secondary cut has been made. The return element 146A, 146B is interposed between the corresponding secondary blade 142A', 142B' and the corresponding secondary anvil 142A", 142B" along the cutting orientation C.

In an embodiment, the return element 146A, 146B is a compression spring which, once the secondary cut has been made, applies a force on the secondary blade 142A', 142B' such as to move the secondary blade 142A', 142B' away from the secondary anvil 142A", 142B".

It should be noted that the first cutting assembly 14A and the second cutting assembly 14B are spaced along the transverse orientation T by a changeover-dependent distance defined by the size of the paper sheet being processed. The changeover-dependent distance is therefore variable.

In an embodiment, the machine 1 comprises a changeover actuator 143. The changeover actuator 143 is configured to vary the changeover-dependent distance.

In one embodiment, the machine comprises a transverse transmission 144. The transverse transmission 144 is configured to transmit the motion of the changeover actuator 143 to the first cutting assembly 14A and to the second cutting assembly 14B.

In an embodiment, the transverse transmission 144 is configured to convert the rotational motion of the changeover actuator 143 into a translational motion along the transverse orientation T of the first cutting assembly 14A and of the second cutting assembly 14B.

In an embodiment, the transverse transmission 144 is configured to translate the first cutting assembly 14A and the second cutting assembly 14B along the transverse orientation T: the former in a first direction and the latter in a second direction, opposite to the first direction.

To do that, in a preferred embodiment, the transverse transmission 144 includes a worm screw coupled to the first cutting assembly 14A with a right-hand (or left-hand) thread and to the second cutting assembly 14B with a left-hand (or right-hand) thread.

In an embodiment, the changeover actuator 143 and the transverse transmission 144 are disposed on one side of the machine 1, opposite to the side from which the paper sheet is loaded.

More specifically, each cutting assembly 14A and 14B comprises, on a rear surface of it, a respective bracket 144A, 144B on which the transverse transmission 144 is engaged.

In an embodiment, the control unit 12 is programmed to generate drive signals 122 as a function of the configuration data 121 and to send them to the changeover actuator 143 to instruct it to move the first cutting assembly 14A and the second cutting assembly 14B along the transverse orientation T.

In an embodiment, the machine comprises a rear pusher 145. The rear pusher 145 is coupled to the transverse transmission 144 (for example by a screw) and is configured to move along the longitudinal orientation L in response to a rotation of the transverse transmission T. That way, when the size changes, the rear pusher 145 is configured to advance or retract so as to abut properly against the rear edge of the paper sheet. In an embodiment, the longitudinal movement of the rear pusher 145 and the transverse movements of the first and second cutting assemblies 14A and 14B are synchronized.

In an embodiment, the carriage 132 is movable along the longitudinal orientation between a first position, where each primary cutting unit 141A, 141B is configured to make the primary cut T1, and a second position, where each secondary cutting unit 142A, 142B is configured to make the secondary cut T2.

Each primary blade 141A', 141B' is disposed at a first (longitudinal) coordinate $x_1$, with the carriage 132 at the first position, for example with a tip of it defining a longitudinal limit of the primary blade 141A', 141B (preferably in a direction opposite to the sheet loading direction) at the first longitudinal coordinate $x_1$, with the carriage 132 at the first position. Also, when the carriage 132 is at the first position, the transverse sidewall of each primary blade 141A', 141B' (preferably extending along the transverse orientation) is at a third longitudinal coordinate $x_3$.

The distance between the first coordinate $x_1$ and the third longitudinal coordinate $x_3$ defines the depth of a fold-over flap, that is to say, of a portion of the blank which comes into contact with the inside surfaces of the box.

Each secondary blade 142A', 142B' is disposed at a second (longitudinal) coordinate $x_2$, with the carriage 132 at the second position, for example with a sidewall of it defining a longitudinal limit of the secondary blade 142A', 142B (preferably in a direction opposite to the sheet loading direction) at the second longitudinal coordinate $x_2$, with the carriage 132 at the second position.

Cutting the blank also allows defining a base zone ZB that is configured to be glued to a base of the box on which the blank will be applied. Thus, according to an aspect of this disclosure, the first longitudinal coordinate $x_1$,—that is to say, the longitudinal position of the tip of the primary blade—is a function of the base of the box on which the blank will be applied.

In an embodiment, the distance between the first longitudinal coordinate $x_1$ and the second longitudinal coordinate $x_2$ is variable as a function of the thickness of the cardboard which the paper blank will have to cover. Thus, during changeover operations, the machine 1 is configured to allow adjusting the distance between the first longitudinal coordinate $x_1$ and the second longitudinal coordinate $x_2$.

For this purpose, this disclosure provides two solutions.

In a first embodiment, the machine 1 comprises a stop 15A, 15B for the first cutting assembly 14A and the second cutting assembly 14B, respectively. The stop 15A, 15B is disposed on a rear side of the machine, opposite to the side of the machine 1 where the sheet is loaded.

The stop 15A, 15B is aligned longitudinally with the respective cutting assembly 14A, 14B. In an embodiment, the stop 15A, 15B is aligned longitudinally with the carriage 132.

That way, the stop 15A, 15B is configured to abut against the carriage 132 (or the respective cutting assembly 14A, 14B) during its movement along the longitudinal orientation L and in the same direction as the sheet loading direction The stop 15A, 15B thus defines the maximum stroke of the carriage 132 (or of the respective cutting assembly 14A, 14B). The stop 15A, 15B defines the second longitudinal coordinate $x_2$.

In an embodiment, each stop comprises a respective motor 15A', 15B'. The term "motor" is used to mean any actuator responsible for driving the respective stop 15A, 15B.

In an embodiment, the motor 15A' 15B' is configured to move the corresponding stop 15A, 15B along the longitudinal orientation L in order to vary the stroke of the carriage 132 (or of the respective cutting assembly 14A, 14B). In an embodiment, the motor 15A' 15B' is configured to move the corresponding stop 15A, 15B along the longitudinal orientation L in order to vary the second longitudinal coordinate $x_2$.

In an embodiment, the control unit 12 is programmed to generate the drive signals 122 as a function of the configuration data 121, which represent the thickness of the box that the blank will have to cover. The control unit 12 is programmed to send the drive signals 122 to the motor 15A', 15B' to instruct it to move the corresponding stop 15A, 15B along the longitudinal orientation L.

In an embodiment, the stop 15A, 15B might be fixed to the frame. In this embodiment, the first cutting assembly 14A and the second cutting assembly 14B each comprise a respective adjustment assembly. The adjustment assembly comprises an adjustment slide and a corresponding adjustment element.

The secondary cutting unit 142A, 142B is disposed on the adjustment slide and is movable thereon along the longitudinal orientation L. The adjustment element is configured to adjust the position of the secondary cutting unit 142A, 142B on the corresponding slide to vary the distance between the primary cutting unit 141A, 141B and the secondary cutting unit 142A, 142B.

The adjustment element is configured to adjust the position of the secondary cutting unit 142A, 142B on the corresponding slide to vary the second longitudinal coordinate $x_2$.

In an embodiment, the adjustment element is a calibrated knob that can be turned manually to move the secondary cutting unit 142A, 142B on the corresponding slide.

In an embodiment, the adjustment element is a dedicated motor connected to the control unit to receive the drive signals 122 that represent the position of the secondary cutting unit 142A, 142B on the corresponding slide. The dedicated motor is configured to move the secondary cutting unit 142A, 142B as a function of the drive signals 122.

In an embodiment, the two solutions described above might even coexist, so as to allow the second longitudinal coordinate $x_2$ to be adjusted in two ways. For example, the stop might be motor-driven and used as a first means of adjustment, whilst the solution with the slide and knob might be used if the first means of adjustment does not work.

In an embodiment, the machine comprises a pusher assembly 16. The pusher assembly 16 is configured to move the primary blades 141A', 141B' relative to the corresponding primary anvils 141A", 141B" along the cutting orientation C. The pusher assembly 16 is configured to move the secondary blades 142A', 142B' relative to the corresponding secondary anvils 142A", 142B" along the cutting orientation C.

The pusher assembly comprises a first beam 161, connected to the primary cutting unit 141A, 141B. In an embodiment, the first beam is attached to the primary cutting units 141A, 141B so that the primary cutting units 141A, 141B follow all the movements of the first beam 161.

The pusher assembly comprises a second beam 162. The second beam is movable as one with the first beam 161. The second beam is configured to come into contact with the secondary cutting units 142A, 142B.

More specifically, the second beam 162 has a double T-section in a plane perpendicular to the transverse orientation T.

Each secondary cutting unit 142A, 142B comprises a corresponding hooking element 142A'", 142B'". The hooking element 142A'", 142B'" is configured to be hooked to the second beam 162.

More specifically, the coupling between the second beam 162 and the hooking elements 142A'", 142B'" allows delaying the movement of the secondary blades 142A', 142B' relative to the movement of the primary blades 141A', 141B'.

In effect, the second beam 162 is movable between a contact configuration C1, in which the second beam 162 and the hooking elements 142A'", 142B'" have at least one contact surface that is parallel to the worktop P, and a sliding configuration C2, where the second beam 162 and the hooking elements 142A'", 142B'" are free to slide relative to each other along the cutting orientation C.

Thus, the secondary blades 142A', 142B' are moved with the beam 162 in the contact configuration C1. When the primary cut is made, on the other hand, the second beam is in the sliding configuration C2, so that the secondary blade 142A', 142B' is not activated while the primary cut is being made.

Thus, the second beam is at a lower level along the cutting orientation C in the contact configuration C1 than it is in the sliding configuration C2.

When the secondary cut is made, the primary blades 141A', 141B' are moved along the cutting orientation C but the primary cutting units 141A, 141B are not aligned with the sheet along the cutting orientation and do not make any cut on the paper sheet.

In an embodiment, the machine 1 comprises a transmission system 17. In one embodiment, the machine comprises a single actuator 171. The transmission system 17 is a mechanical transmission system. The mechanical transmission system 17 is configured to transmit the rotational motion of the single actuator 171 to the carriage 132 and/or to the first cutting assembly 14A and/or to the second cutting assembly 14B and/or to the pusher assembly 16.

In an embodiment, the mechanical transmission system 17 is configured to convert the rotation of the single actuator 171 to one or more of the following movements:

- longitudinal movement of the carriage 132;
- longitudinal movement of the first cutting assembly 14A;
- longitudinal movement of the second cutting assembly 14B;
- movement of the pusher assembly 16 along the cutting orientation C;
- movement of the primary blades 141A', 141B' along the cutting orientation C;
- movement of the secondary blades 142A', 142B' along the cutting orientation C.

It should be noted that in other embodiments, a person skilled in the art might use a dedicated actuator for each of the movements listed above. Furthermore, a control logic, implemented in the control unit 12, might be provided to synchronize the activation of the different actuators in order to synchronize these movements.

In the preferred embodiment, however, the mechanical transmission system 17 is configured to synchronize the longitudinal movement of the carriage 132 with the movement of the pusher assembly 16 along the cutting orientation C (or with the movement of the primary blades 141A', 141B' and of the secondary blades 142A', 142B' along the cutting orientation C).

In an embodiment, the mechanical transmission system is configured to perform the following in sequence:

- a first movement of the pusher assembly 16 along the cutting orientation C;
- the longitudinal movement of the carriage 132;
- a second movement of the pusher assembly 16.

In an embodiment, the single actuator 171 is an alternating current or direct current electric motor. In some embodiments, the electric motor might be a stepping motor (step motor) which notches two corners of the paper sheet at every step.

In an embodiment, the transmission system comprises a rotary shaft 172. The rotary shaft 172 is connected to the drive shaft of the single actuator 171. In an embodiment, the rotary shaft 172 is parallel to the transverse orientation T.

The transmission system 17 comprises a first transmission assembly 173. The first transmission assembly 173 is configured to convert the rotational motion of the rotary shaft 172 into the translational motion of the carriage 132 along the longitudinal orientation L. The first transmission assembly 173 comprises a first crank 173A and a second crank 173B. The first transmission assembly 173 comprises a first pushing conrod 173C. The first transmission assembly 173 comprises a pin 173D. The first crank 173A is connected to the rotary shaft 172 to receive the rotational motion. The first crank 173A is connected to the pin 173D which rotates in response to the rotation of the rotary shaft 172. The second crank 173B is connected to the pin 173D. The second crank 173B thus rotates in response to the rotation of the pin 173D. The second crank 173B is connected to the first pushing conrod 173C, which is connected to the carriage 132. The first pushing conrod 173C is configured to convert the rotational motion of the pin 173D into the translational motion of the carriage 132 along the longitudinal orientation L.

The transmission system 17 comprises a second transmission assembly 174. The second transmission assembly 174 is configured to convert the rotational motion of the rotary shaft 172 into the translational motion of the pusher assembly 16 along the cutting orientation C. The second transmission assembly 174 comprises a rocker arm 174A, a receiving conrod 174B, a second pushing conrod 174C and a rotary rod 174D. The rotary shaft 172 is connected to the receiving conrod 174B to impart its motion thereto. The receiving conrod 174B is connected to a first end of the rocker arm 174A, while the second pushing conrod 174C is connected to the opposite end of the rocker arm. The rocker arm 174A is mounted to the rotary rod 174D and rotates about an axis which coincides with the axis of symmetry of the rotary rod 174D. The rotation of the rocker arm 174A thus causes the second pushing conrod 174C to slide along the cutting orientation C. Since the second pushing conrod is connected to the pusher assembly 16, preferably to the first beam 161, it transfers its motion along the cutting orientation C to the pusher assembly, which thus moves the primary blades and/or the secondary blades.

According to one aspect of it, this disclosure provides a method for making a paper blank from a corresponding paper sheet.

The method comprises a step of preparing a frame 10, configured to support the machine 1 on the floor and including a work table 101, defining a worktop P and having a supporting surface S on which the paper sheet is rested.

The method comprises a step of squaring, in which a squarer 101', movable on the worktop P, is moved close to the paper sheet in order to hold it in place so it does not move during notching.

The method comprises a step of loading in which the paper sheet is loaded onto the worktop P along a longitudinal orientation of loading L.

The method comprises a step of collecting, in which a collecting system 11 collects the notching offcuts and conveys them elsewhere.

In an embodiment, the step of collecting comprises a step of conveying the offcuts by means of a collecting conveyor 111 (for example, a collecting belt) driven by a collecting actuator 112, from a drop-off position to a collecting container 113 located on one side of the frame 10 of the machine 1.

In an embodiment, the method comprises a step of controlling by means of a control unit 12 that controls and/or drives the components of the machine 1.

In an embodiment, the method comprises a step of entering configuration data 121A from a user interface 121, the configuration data representing the size of the paper sheet to be notched.

In an embodiment, the method comprises a first step of guiding. In the first step of guiding, a carriage 132 runs along the longitudinal orientation L on a first pair of rails 131, connected to the frame 10 and extending along the longitudinal orientation L.

In an embodiment, the method comprises a second step of guiding. In the second step of guiding, a first cutting assembly 14 and/or a second cutting assembly 14B, disposed on the carriage 132 and spaced along the transverse orientation T, run along the transverse orientation T belonging to the plane defined by the worktop P and perpendicular to the longitudinal orientation, on a second pair of rails 133, connected to the frame 10 and extending along the transverse orientation T.

In an embodiment, the second pair of rails 133 is moved as one with the carriage 132 along the longitudinal orientation L in the first step of guiding.

For each first and second cutting assembly 14A and 14B, the method comprises a respective step of primary cutting by means of a corresponding primary cutting unit 141A, 141B.

For each first and second cutting assembly 14A and 14B, the method comprises a respective step of secondary cutting by means of a corresponding secondary cutting unit 142A, 142B.

In an embodiment, each step of primary cutting comprises a step of sliding a primary blade 141A', 141B' and a respective primary anvil 141A", 141B" relative to each other.

In an embodiment, each step of secondary cutting comprises a step of sliding a secondary blade 142A', 142B' and a respective secondary anvil 142A", 142B" relative to each other.

The primary cutting units and the secondary cutting units perform shear cuts, that is to say, cuts made by the blade and anvil sliding along the cutting orientation until they move past each other.

In an embodiment, the method comprises a step of longitudinally moving the carriage 132 along the longitudinal orientation L.

In an embodiment of the method, the step of primary cutting, the step of longitudinally moving the carriage 132 and the step of secondary cutting are performed in succession.

In an embodiment, the method comprises a step of returning, in which a return element 146A, 146B, interposed between the corresponding secondary blade 142A', 142B' and the corresponding secondary anvil 142A", 142B" along the cutting orientation C, causes the secondary blade to return to its rest position after making the secondary cut.

In an embodiment, the step of returning is a spring return action applied by a compression spring.

The first cutting assembly 14A and the second cutting assembly 14B are spaced along the transverse orientation T by a changeover-dependent distance defined by the size of the paper sheet being processed.

In an embodiment, the method comprises a step of changeover.

In the step of changeover, a changeover actuator 143 drives a transverse transmission T to vary the changeover-dependent distance.

In the step of changeover, the transverse transmission 144 transmits the motion of the changeover actuator 143 to the first cutting assembly 14A and to the second cutting assembly 14B. The transverse transmission 144 converts the rotational motion of the changeover actuator 143 into a translational motion along the transverse orientation T of the first cutting assembly 14A and of the second cutting assembly 14B.

In a preferred embodiment, the method comprises a step of rotating a worm screw that is coupled to the first cutting assembly 14A with a right-hand (or left-hand) thread and to the second cutting assembly 14B with a left-hand (or right-hand) thread in order to reverse the direction of translation of the first cutting assembly 14A relative to the second cutting assembly 14B.

In an embodiment, in the step of controlling, the control unit generates drive signals 122 as a function of the configuration data 121 and sends them to the changeover actuator 143 to instruct it to move the first cutting assembly 14A and the second cutting assembly 14B along the transverse orientation T.

In an embodiment, in the step of longitudinally moving the carriage 132, the carriage 132 is moved along the longitudinal orientation L between a first position, where each primary cutting unit makes the primary cut, and a second position, where each secondary cutting unit makes the secondary cut.

In the step of longitudinally moving the carriage 132, each primary blade 141A', 141B and each secondary blade 142A', 142B' change their longitudinal positions. More specifically, when the carriage 132 is at the first position, a tip of each primary blade 141A', 141B' defining a longitudinal limit of the primary blade 141A', 141B' (preferably in a direction opposite to the sheet loading direction) is at a first longitudinal coordinate $x_1$. When the carriage 132 is at the second position, a (transverse) sidewall of each secondary blade 142A', 142B' defining a longitudinal limit of the secondary blade 142A', 142B' (preferably in a direction opposite to the sheet loading direction) is at a second longitudinal coordinate $x_2$.

In an embodiment, the distance between the first longitudinal coordinate $x_1$ and the second longitudinal coordinate $x_2$ is varied as a function of the thickness of the cardboard which the paper blank will have to cover. Thus, during changeover operations, the machine 1 varies the distance between the first longitudinal coordinate $x_1$ and the second longitudinal coordinate $x_2$.

For this purpose, this disclosure provides two embodiments of the method.

In a first embodiment, the method comprises, for each of the first cutting assembly 14A and second cutting assembly 14B, a step of abutting in which a respective stop 15A, 15B, disposed on a rear side of the machine, opposite to the side of the machine 1 where the sheet is loaded, comes into abutment against the carriage 132 along the longitudinal orientation L in the direction of sheet loading to define the maximum stroke of the carriage 132, hence the longitudinal coordinate $x_2$.

In an embodiment, the method comprises a step of moving the stop 15A, 15B, in which a motor 15A' 15B' of each stop 15A, 15B, moves the corresponding stop 15A, 15B along the longitudinal orientation L in order to vary the stroke of the carriage 132 (or of the respective cutting assembly 14A, 14B), that is to say, to vary the second longitudinal coordinate $x_2$.

In an embodiment, in the step of controlling, the control unit 12 generates the drive signals 122 as a function of the configuration data 121, which represent the thickness of the box that the blank will have to cover. The control unit 12 sends the drive signals 122 to the motor 15A', 15B' to instruct it to move the corresponding stop 15A, 15B along the longitudinal orientation L.

In an embodiment, the method comprises a third step of guiding, in which the secondary cutting unit 142A, 142B is moved relative to the primary cutting unit 141A, 141B by means of a respective adjustment assembly.

In the third step of guiding, the secondary cutting unit 142A, 142B, driven by an adjustment element, runs on an adjustment slide along the longitudinal orientation L.

In an embodiment, the third step of guiding is carried out manually by turning a calibrated knob (adjustment element) to move the secondary cutting unit 142A, 142B on the corresponding slide.

In other embodiments, the adjustment element is a dedicated motor connected to the control unit: the dedicated motor receives the drive signals 122 that represent the position of the secondary cutting unit 142A, 142B on the corresponding slide and moves the secondary cutting unit 142A, 142B as a function of the drive signals 122.

In an embodiment, the method comprises a step of moving vertically along the cutting orientation C, parallel to the orientation of the weight force. In the step of moving vertically, a pusher assembly 16 moves the primary blades 141A', 141B' relative to the corresponding primary anvils 141A", 141B" along the cutting orientation C by means of a first beam 161. In the step of moving vertically, a pusher assembly 16 moves the secondary blades 142A', 142B' relative to the corresponding secondary anvils 142A", 142B" along the cutting orientation C by means of a second beam 162.

In an embodiment, the step of moving vertically comprises a step of selectively hooking, in which a hooking element 142A'", 142B'" of each secondary cutting unit 142A, 142B hooks the second beam 162.

More specifically, the step of selectively hooking allows delaying the movement of the secondary blades 142A', 142B' relative to the movement of the primary blades 141A', 141B'.

In the step of selectively hooking, the second beam 162 moves between a contact configuration C1, in which the second beam 162 touches the hooking elements 142A'", 142B'" at at least one contact surface that is parallel to the worktop P, and a sliding configuration C2, in which the second beam 162 is spaced from the hooking elements 142A'", 142B'" along the cutting orientation C.

Thus, when the primary cutting units make the primary cut, the second beam 162 is in the sliding configuration C2 to prevent the secondary cut from being made on a wrong portion of the sheet.

In the step of secondary cutting, on the other hand, the second beam 162 is made to slide further vertically so that it comes into contact with, and moves, the secondary blades 142A', 142B' in order to make the secondary cut. Also, between the time the primary cut is made and the time the secondary cut is made, the carriage 132 is moved longitudinally and the primary cutting units 141A, 141B are no longer aligned with the paper sheet along the cutting orientation C. Thus, although they slide along the cutting orientation C, they do not interact with the paper sheet.

In an embodiment, the method comprises a step of transmitting, in which a mechanical transmission system 17 transmits the rotational motion of a single actuator 171 of the machine 1 to the carriage 132 and/or to the first cutting assembly 14A and/or to the second cutting assembly 14B and/or to the pusher assembly 16.

In an embodiment, the mechanical transmission system 17 converts the rotation of the single actuator 171 into one or more of the following movements:

- longitudinal movement of the carriage 132;
- longitudinal movement of the first cutting assembly 14A;
- longitudinal movement of the second cutting assembly 14B;
- movement of the pusher assembly 16 along the cutting orientation C;
- movement of the primary blades 141A', 141B' along the cutting orientation C;
- movement of the secondary blades 142A', 142B' along the cutting orientation C.

In a preferred embodiment, the mechanical transmission system 17 synchronizes the longitudinal movement of the carriage 132 with the movement of the pusher assembly 16 along the cutting orientation C (or with the movement of the primary blades 141A', 141B' and of the secondary blades 142A', 142B' along the cutting orientation C).

In an embodiment, the transmission system performs the following movements, in chronological order:

- a first movement of the pusher assembly 16 along the cutting orientation C;
- the longitudinal movement of the carriage 132;
- a second movement of the pusher assembly 16.

In the first movement of the pusher assembly, the second beam 162 is in the sliding configuration C2 and the secondary blades 142A', 142B' are stationary, whilst the primary blades 141A', 141B' are moving to make the primary cut.

The longitudinal movement causes the primary cutting units 141A, 141B to move out of alignment with the paper sheet along the cutting orientation C, whilst the secondary cutting units 142A, 142B are positioned at the second longitudinal coordinate $x_2$.

Lastly, in the second movement of the pusher assembly 16, the second beam 16 is in the contact configuration C1 and transmits its movement to the secondary blades 142A', 142B' along the cutting orientation C to make the secondary cut.

In an embodiment, the method comprises a first step of transmitting, in which a first transmission assembly 173 converts the rotational motion of the rotary shaft 172 into the translational motion of the carriage 132 along the longitudinal orientation L. In the first step of transmitting, a first crank 173A receives the rotational motion of a rotary shaft 172 of the mechanical transmission system 17 and transmits it to a pin 173D of the first transmission assembly 173. A second crank 173B of the first transmission assembly is mounted to the pin 173D and thus rotates in response to the rotation of the pin 173D. The second crank 173B is connected to the first pushing conrod 173C, which is connected to the carriage 132. A first pushing conrod 173C of the first transmission assembly 173 receives the motion from the second crank 173B and converts it into the translational motion of the carriage 132 along the longitudinal orientation L.

In an embodiment, the method comprises a second step of transmitting, in which a second transmission assembly 174 converts the rotational motion of the rotary shaft 172 into the translational motion of the pusher assembly 16 along the cutting orientation C. In the second step of transmitting, a receiving conrod 174B receives motion from the rotary shaft 172 and transmits it, through a rocker arm 174A, to a second pushing conrod 174C. The second pushing conrod 174C converts the rotational motion of the rocker arm 174A into the translational motion of the pusher assembly 16, preferably of the first beam 161.

What is claimed is:

1. A method for making a paper blank from a corresponding paper sheet, comprising the following steps:

providing:

a frame, a carriage movable with respect to the frame between a first position and a second position, and a first cutting assembly and a second cutting assembly, each including a primary cutting unit and a secondary cutting unit, the primary cutting unit and the secondary cutting unit being connected to the carriage;

loading a paper sheet along a longitudinal orientation, resting on a supporting surface that defines a worktop;

while the carriage is in the first position, using each primary cutting unit to make a corresponding primary shear cut on the paper sheet, each primary cutting unit including a primary blade and a primary anvil sliding relative to one another along a cutting orientation perpendicular to the worktop, so to provide the corresponding primary shear cut;

moving the carriage parallel to the worktop, from the first position to the second position;

while the carriage is in the second position, using each secondary cutting unit to make a corresponding secondary shear cut, each secondary cutting unit including a secondary blade and a secondary anvil sliding relative to each other along the cutting orientation to provide the corresponding secondary shear cut, wherein each primary cutting unit and secondary cutting unit is actuated through an actuating assembly, and wherein each primary shear cut defines a corresponding primary cutting line and each secondary shear cut defines a corresponding secondary cutting line, each secondary cutting line being made on an associated primary cutting line.

2. The method according to claim 1, wherein the step of moving the carriage includes moving the carriage along the longitudinal orientation between the first position, where each primary cutting unit makes its corresponding primary cut, and the second position, where each secondary cutting unit makes its corresponding secondary cut.

3. The method according to claim 2, comprising a step of mechanically transmitting, in which a mechanical transmission system moves each primary blade relative to its corresponding primary anvil and each secondary blade relative to its corresponding secondary anvil along the cutting orientation, and in which the mechanical transmission system moves the carriage along the longitudinal orientation, wherein the mechanical transmission system is driven by a single actuator of the actuating assembly.

4. The method according to claim 3, wherein the step of mechanically transmitting includes a step of synchronizing, in which the movement of each primary blade relative to its corresponding primary anvil along the cutting orientation, the movement of each secondary blade relative to the its corresponding secondary anvil along the cutting orientation, and the movement of the carriage along the longitudinal orientation are synchronized according to a predetermined operating sequence.

5. The method according to claim 3, wherein the step of mechanical transmitting comprises:

a first step of transmitting, in which a first transmission element converts rotation of an operating actuator into a displacement of each primary blade relative to its corresponding primary anvil along the cutting orientation;

a second step of transmitting, in which a second transmission element converts the rotation of the operating actuator into a displacement of each secondary blade relative to its corresponding secondary anvil along the cutting orientation.

6. The method according to claim 3, wherein the mechanical transmission system performs a step of pushing, wherein a pushing element adjusts the displacement of each primary blade and each secondary blade along the cutting orientation.

7. The method according to claim 2, wherein:

each primary blade is disposed at a corresponding first longitudinal coordinate when the carriage is at the first position, each secondary blade is disposed at a corresponding second longitudinal coordinate when the carriage is at the second position, and the method comprises a step of adjusting a distance between the second longitudinal coordinate and the first longitudinal coordinate.

8. The method according to claim 7, wherein the step of adjusting comprises a step of adjusting a stop, which is moved along the longitudinal orientation to define a limit to the movement of the carriage along the longitudinal orientation.

9. A method for making a paper blank from a corresponding paper sheet, comprising the following steps:

providing:

a frame, a carriage movable with respect to the frame between a first position and a second position, a first cutting assembly and a second cutting assembly, each including a primary cutting unit and a secondary cutting unit, the primary cutting unit and the secondary cutting unit being connected to the carriage;

loading a paper sheet along a longitudinal orientation, so that the paper sheet rests on a supporting surface that defines a worktop, the supporting surface being oriented horizontally, perpendicular to a vertical direction;

with the carriage located at the first position, using each primary cutting unit to make a corresponding primary shear cut on the paper sheet, so that a primary notch is applied to the paper sheet by shear cutting;

using a mechanical transmission system to move the carriage parallel to the worktop, from the first position to the second position;

with the carriage located at the second position, using each secondary cutting unit to make a corresponding secondary shear cut, so that a secondary notch is applied to the paper sheet by shear cutting, and wherein each primary shear cut defines a corresponding primary cutting line and each secondary shear cut defines a corresponding secondary cutting line, each secondary cutting line being made on an associated primary cutting line.

10. The method according to claim 9, wherein each primary cutting unit and secondary cutting unit is actuated through the mechanical transmission system.

* * * * *